US006382363B1

(12) United States Patent
Friedli

(10) Patent No.: US 6,382,363 B1
(45) Date of Patent: May 7, 2002

(54) METHOD FOR PRESELECTING A DESTINATION FLOOR IN AN ELEVATOR INSTALLATION

(75) Inventor: Paul Friedli, Remetschwil (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/494,559

(22) Filed: Jan. 31, 2000

(30) Foreign Application Priority Data

Jan. 29, 1999 (EP) ..... 99101917

(51) Int. Cl.[7] ..... B66B 1/20
(52) U.S. Cl. ..... 187/384; 187/392
(58) Field of Search ..... 187/384, 387, 187/388, 389, 392, 385

(56) References Cited

U.S. PATENT DOCUMENTS

| | | | | | |
|---|---|---|---|---|---|
| 4,673,911 | A | * | 6/1987 | Yoshida | 187/100 |
| 4,979,594 | A | * | 12/1990 | Begle et al. | 187/121 |
| 5,554,832 | A | * | 9/1996 | Lumme et al. | 187/380 |
| 5,689,094 | A | * | 11/1997 | Friedli et al. | 187/384 |
| 5,749,443 | A | * | 5/1998 | Romao | 187/384 |
| 5,952,626 | A | * | 9/1999 | Zaharia | 187/381 |
| 5,984,051 | A | * | 11/1999 | Morgan et al. | 187/392 |
| 6,109,396 | A | * | 8/2000 | Sirag et al. | 187/381 |
| 6,202,799 | B1 | * | 3/2001 | Drop | 187/388 |
| 6,209,685 | B1 | * | 4/2001 | Zaharia et al. | 187/392 |

FOREIGN PATENT DOCUMENTS

| | | | |
|---|---|---|---|
| EP | 341 381 | | 11/1989 |
| EP | 879 782 | | 11/1998 |
| JP | 2-18269 | * | 2/1990 |
| JP | 5-58565 | * | 5/1993 |
| JP | 9-40310 | * | 9/1997 |

* cited by examiner

*Primary Examiner*—Jonathan Salata
(74) *Attorney, Agent, or Firm*—Cohen, Pontani, Lieberman & Pavane

(57) ABSTRACT

This device allows an implicit or explicit input of destination calls on elevator installations. After a corresponding inquiry by a detector, an information transmitter transmits data. This data can contain direct information about the desired destination floor and/or serve as identification of the elevator user and thereby enable access to information about the destination floor which is stored in a memory. The memory is contained in a processing unit of an elevator control. Communication between the detector and the information transmitter takes place, for example, without contact. Using the received data the destination floor is evaluated in the processing unit and communicated to the elevator control. The assignment is communicated to the passenger on a display. The process of inputting a call takes place automatically and independent of the orientation of the information transmitter. To change the floor proposed by the processing unit an input device is provided which can also be used to choose the type of preselection of the destination floor.

7 Claims, 3 Drawing Sheets

ANTENNA
INFORMATION TRANSMITTER
1
2
1
4
6
TRANSMITTER BLOCK 3
1ST MEMORY 3.1
11
5
DETECTOR
ELECTRONICS BLOCK 12
CARD READER 12.1
13
8
9
14
15
10
16
17
20
18
MR. MUSTER - 5. FLOOR - ELEVATOR A DISPLAY
19
INPUT DEVICE

METHOD FOR PRESELECTING A DESTINATION FLOOR IN AN ELEVATOR INSTALLATION

BACKGROUND OF THE INVENTION

1. Field of the Invention

The invention relates to a method for using an elevator installation having a detector, which automatically reads data from an information transmitter carried by an elevator user, and a processing unit connected to the detector which, when it has recognized individual characteristics of the elevator user, preselects a changeable destination floor and communicates it to the elevator user.

2. Discussion of the Prior Art

European reference EP 341 381 teaches a method and a device for the secure and convenient input of control commands, particularly on elevator installations, which has a portable wireless transmitter by means of which control commands can be transmitted to the elevator control. The portable transmitter has two different operating modes, "manual/pushbutton" and "automatic/permanent". The desired operating mode can be set by means of an operating mode selector on the transmitter unit. In the "manual/pushbutton" mode the desired destination floor can be entered directly using a ten-digit keypad on the transmitter unit and transmitted to the elevator control. In the "automatic/permanent" mode of operation the transmitter communicates at specified time intervals information regarding the desired destination floor to the elevator control. Acknowledgment and/or signalization takes place on a display mounted on the transmitter. In this way the user is informed that his destination call has been registered and which elevator he must use.

In the method described above, the portable transmitter has various function keys and a display, which means that the transmitter always has to be taken into the hand to specify the desired operating mode. This makes it impractical to operate the transmitter if a passenger has no free hand. Furthermore, in both operating modes, acknowledgment of the input and the assigned car are only indicated on the display of the transmitter, which the passenger therefore has to take out of his pocket each time to read the display. Moreover, because of the function keys and the display, the dimensions are too large to permit the transmitter to be comfortably carried. Finally, use of a keypad and a display requires a substantial outlay for manufacturing.

SUMMARY OF THE INVENTION

The purpose of the invention is to avoid the disadvantages of the known device and to provide an elevator installation which the passenger can use conveniently and securely.

The advantages resulting from the invention relate mainly to the fact that by means of the information transmitters carried by the elevator users, or by recognition of characteristics of the elevator users, the desired destination floor is automatically communicated to the elevator control without any personal action on the part of the elevator passenger. Safety in buildings is increased by authorizing access only to certain floors. A further advantage is that the elevator users can influence the destination floor preselection according to their personal preference and within their access authorization.

By using an information memory the elevator control receives additional transport criteria as well as the desired destination floor. With the aid of an input device installed in the vicinity of the elevator, the passenger can change the destination floor after he has made his choice and within his access authorization. In addition, the input is visually and/or acoustically acknowledged, and on elevators with several elevator cars, for example, the car assigned to the call is indicated to the user.

The various features of novelty which characterize the invention are pointed out with particularity in the claims annexed to and forming a part of the disclosure. For a better understanding of the invention, its operating advantages, and specific objects attained by its use, reference should be had to the drawings and descriptive matter in which there are illustrated and described preferred embodiments of the invention.

DETAILED DESCRIPTION OF THE PREFERRED EMBODIMENTS

Figure 1:
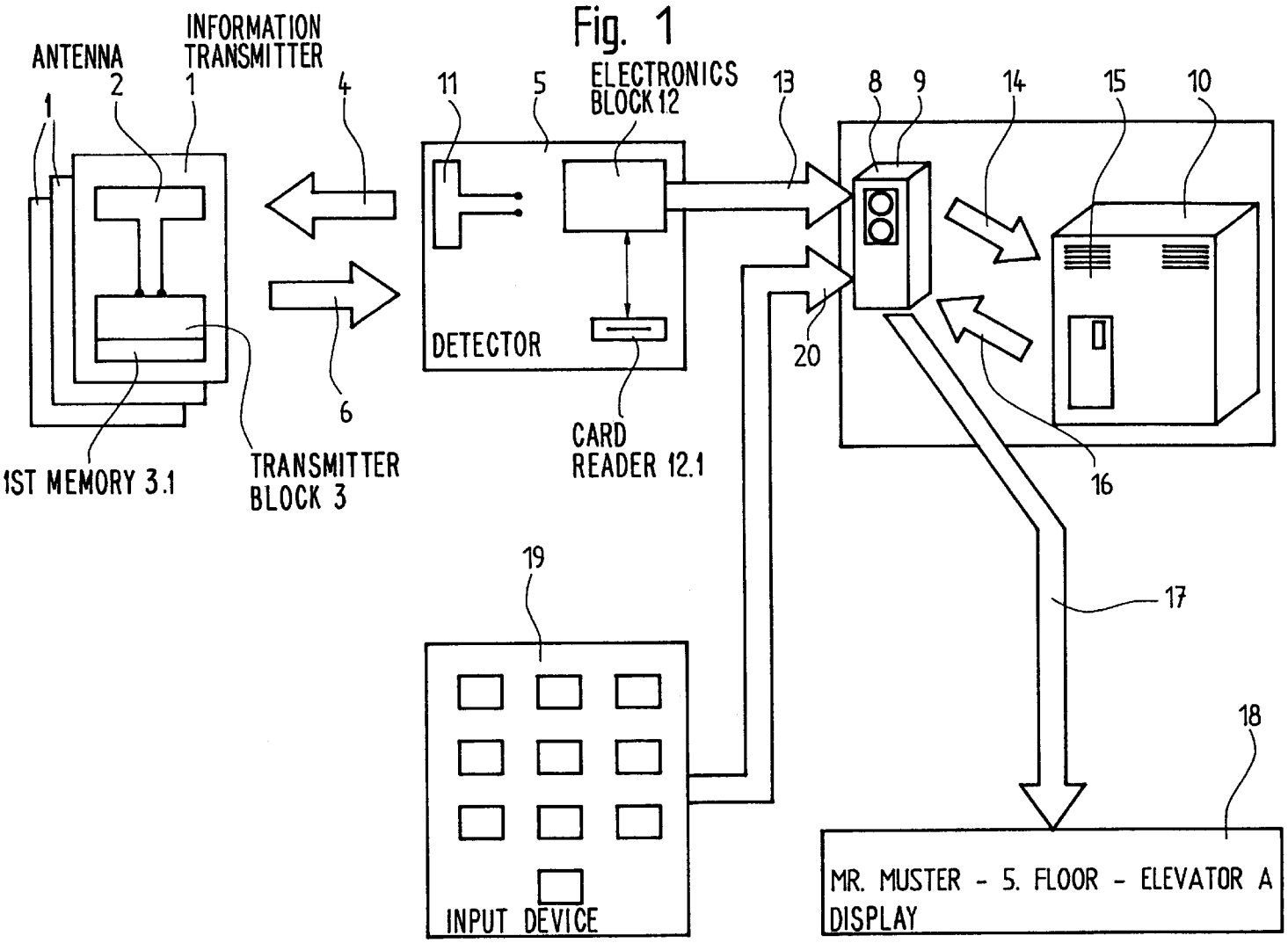
FIG. 1 is a schematic diagram of a device for implementing the method according to the invention.
Figure 2:
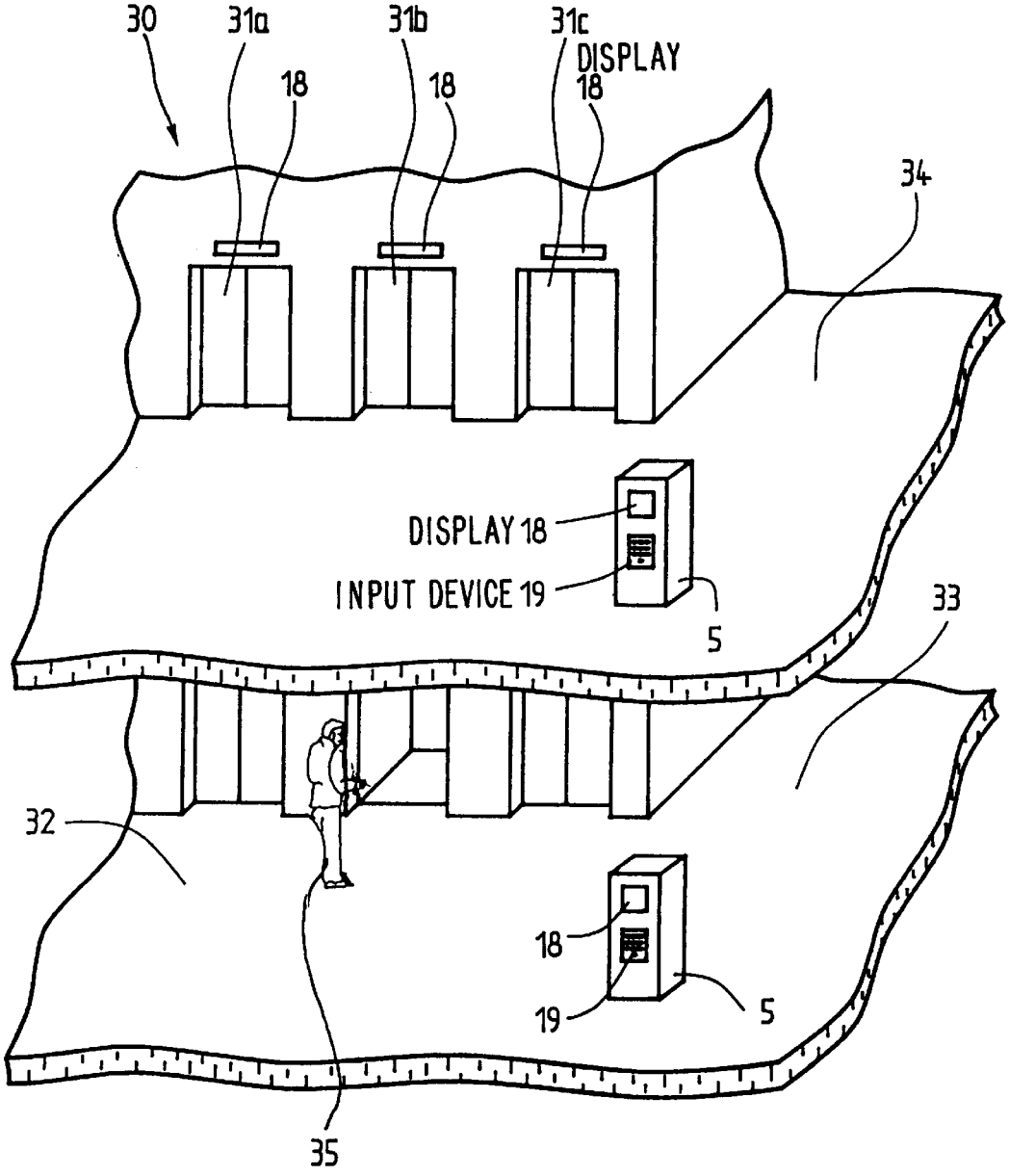
FIG. 2 is a layout and an outline structure of an elevator installation for using the method according to the invention.
Figure 3:
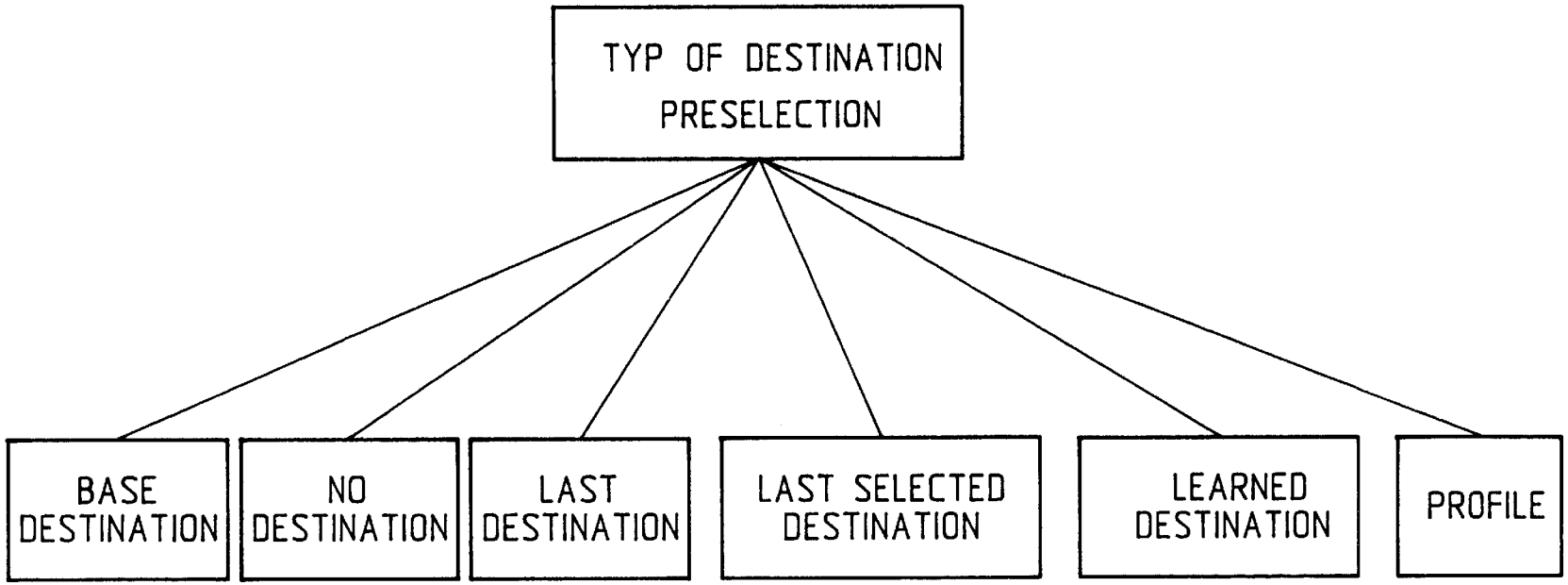
FIG. 3 is a schematic representation of the choice of methods for preselecting the destination floor according to the invention.

FIGS. 1 and 2 have been made known with European reference EP 0 699 617 A1. In FIGS. 1 to 3, 1 designates an information transmitter which can take the form of, for example, a card in credit card format, or a key fob, or a part of a key. This information transmitter 1 consists essentially of a transmission device taking the form of, for example, an antenna 2 and a transmitter electronics block 3. The electronics block 3 has a transmitter and receiver unit and a first memory 3.1 with an identification code. To provide electric power to the electronics block 3 a battery, preferably a long-life battery, is mounted on the information transmitter 1. It is also possible for the information transmitter 1 to be implemented as a passive element, and for power to be supplied to it via a magnetic field. Outside the vicinity of the elevator, the transmitter electronics block 3 is inactive and is activated by, for example, an electromagnetic field 4 radiated by a detector 5. Following a corresponding inquiry by the detector 5 the information transmitter 1 transmits data 6 to the detector 5. This data 6 can contain direct information concerning the desired destination floor, for example the floor number, and/or the data 6 serves as identification (identification code) of an elevator user 35 and enables access to information about the destination floor stored in a second memory 8. After a specified time without communication, the information transmitter 1 returns to the inactive state. The second memory 8 is contained in a processing unit 9 of an elevator installation, and contains the information about the destination floor. As a variant, the second memory 8 containing the destination floor information can be mounted directly on the information transmitter 1. In this case the detector 5 receives the information about the destination floor directly. Furthermore, the memory 8 contains additional individual transport criteria and data relating to passengers such as passenger name, data concerning the amount of space required, solo trip (for example for important persons, hospital beds, food transport, garbage transport, etc.), priority trip, prolonged door open time for persons with impaired mobility, service for physically handicapped persons, operating mode for car cleaning, special modes of operation in hospitals and hotels, etc. The detector 5 is equipped with at least one antenna 11 and monitors a specific part of the building in the approach to an elevator installation. It automatically scans the respective part of the building for information transmitters 1 and manages the communication with an electronics block 12. The electronics block 12 comprises a transmitter and receiver unit and a communication manager. The communication between the detector 5 and the information transmitter 1 can, for example, take place at radio frequencies or in the infrared range. The detector 5 can also be equipped with a card reader 12.1, which serves to provide non-contactless communication between the detector 5 and an information transmitter 1 taking the form, for example, of a chip card with contacts. The memory 8 on the information transmitter 1 or the processing unit 9 can be read, and preferably also written, by the detector 5. The detector 5 transmits the data 6 received from the information transmitter 1 via a conducting wire 13 to the processing unit 9. Using the data 6 the destination floor is evaluated in the processing unit 9, and a corresponding call 14 is generated by an assignment algorithm 15 and passed on to the elevator control 10. The received assignment 16 can be combined with, for example, the name of the passenger, the destination floor, or a transport need and communicated to the passenger. This takes place either via a conducting wire 17 and a display 18 or acoustically, for example by means of speech synthesis. In the case of an elevator installation having only one elevator, there is no communication of the assignment 16. If the processing unit 9 cannot deduce a probable destination floor from the data 6 after the passenger has been identified, it prompts the passenger via display 18 or acoustically to enter his destination floor on an input device 19. The processing unit 9 either has its own computer or is integrated in the elevator control 10. In the case of elevator installations with several elevator cars, the elevator control 10 usually functions as a destination call control such as is known, for example, from European reference EP 246 395. The entire contactless process of entering a call takes place without using the hands, and independent of the orientation of the information transmitter 1, which also means that for identification to take place the information transmitter 1 need not be visible for the detector 5. The compact construction using a minimal number of components allows the information transmitter 1 to be manufactured very inexpensively.

As a variant, the detector 5 can be arranged in such a manner as to recognize a passenger on the basis of an individual characteristic, for example optically (facial contours, fingerprints, iris) or on the basis of speech. If there is a match with the characteristics stored in the memory 8 the detector 5 sends a message to the processing unit 9. In this case there is no need for an information transmitter 1. To change the proposed destination floor an input device 19 is also needed here. The processing unit 9 then evaluates the call as in the exemplary embodiment described above.

In certain cases there need be no input device 19. The passenger can then only reach those floors which he is authorized to enter. The floors authorized for entry are determined from the information stored in the memory 8. In a hotel these can be, for example, the main floor and the floor of the passenger's room.

The information transmitter 1 can also be mounted on any object. On elevators in parking garages or lots of department stores and airports there is the problem that it is not known in advance whether the passenger is accompanied by a baggage or shopping cart. The space management in the elevator must be correspondingly differently planned. Information transmitters 1 on the carts make it easy to determine whether the passenger is arriving alone or accompanied by a cart. In a parking garage the driver of an automobile receives a card with an information transmitter 1 on entering. This card also serves as a ticket for payment of the parking fee. On the floor where he parks he may take a baggage cart with him. As soon as he approaches the elevator he and any cart he may have are recognized by the detector 5 and the present floor number is written on his card (information transmitter 1). In parking garages the destination floor is always the main floor of the building, so he immediately receives an optimal elevator assignment which also takes account of the space he needs. The passenger is now transported to the destination floor. If he returns to the main floor, with or without cart, he is automatically taken to the floor where his car is parked. At the checkpoint for leaving the car park the card (information transmitter 1) is withdrawn again. This variant can also be used in hotels where the card (information transmitter 1) serves additionally as the room key. The main floor and the floor on which the respective room is located are preselected as destination floors.

In a further embodiment the information transmitter 1 is not carried as a separate card but as a coded key. For example, in a residential or office building, the key to the building can bear the information transmitter 1 on it. The detector 5 is then mounted on the door lock in such a manner that as soon as the door is opened the elevator control 10 receives the destination call. In an office building the process can take place, for example, when the time clock for recording hours of attendance is operated.

FIG. 2 shows a layout and the essential construction of an elevator installation 30 for application of the selection method according to the invention, which can also be applied to the use of an elevator installation having only one elevator. A group of elevators having the elevators 31*a*, 31*b* and 31*c* travels from the main stop 32 with the entrance 33 to the upper floors. In the vicinity of the entrance 33, 34 on each floor at least one detector 5 is mounted. The transmitting and receiving area of a detector 5 comprises the entrance assigned to it. The detectors 5 are positioned a few steps away from the elevators 31*a*, 31*b*, 31*c* so that the destination floor is transmitted to the elevator control 10 early, and the assigned elevator arrives at the hoistway door as far as possible before or at the same time as the passenger. In this manner a passenger 35 can be detected, and an elevator 31*a*, 31*b*, 31*c* made available, without him having to stand immediately in front of the detector 5. In the vicinity of the detector 5 an input device 19 is situated for the purpose of changing the proposed destination floor. Above or to the side of the landing doors, and/or on the input device 19, there are display devices 18. The passenger 35 is informed of the assigned elevator and the destination floor implicitly specified by the information transmitter 1 before the elevator 31*a*, 31*b*, 31*c* is present on the boarding floor. If the passenger 35 then wishes to select a different destination floor, he can do this explicitly on the input device 19. The implicitly input call is then cancelled. The processing unit 9 notes this change and for this passenger 35 at the same time of day will always specify the new destination floor to the elevator control 10. After a certain time, so much statistical information about the passenger 35 is contained in the memory 8 that if his habits remain unchanged he is automatically taken to the correct destination floor at any time.

If the passenger wants to go to a floor other than that proposed by the processing unit 9, the destination floor can be changed, or selected, via the input unit 19. The input unit 19 taking the form, for example, of a ten-digit keypad, is mounted in the vicinity of the detector 5 and has a direct connection 20 to the processing unit 9. The new destination floor is added to the memory 8. This procedure makes it possible for the processing unit 9 then to be able to use the identified person, the time of day, the day of the week, and the starting floor to evaluate the usual destination floor of the passenger.

Identification data, as well as the extent of the access authorization (floors authorized for access) for every new elevator user are, for example, transferred by a security manager for the building in question by means of, for example, a separate computer to the information transmitter 1 and the processing unit 9. Within his access authorization the elevator user 35 then has the full range of choices shown in FIG. 3 to influence the preselected destination floor.

As a general rule, after identification of the elevator user, a standard destination floor is automatically preselected which corresponds, for example, to the floor of the office or room of the elevator user. The preselected destination floor is indicated visually on the display 18, and travel to it then takes place.

After identification, the elevator user 35 can cancel the preselection of his standard destination floor by using a certain combination of keys on the input device 19 and choose a different type of destination floor preselection, the following choices being possible as a minimum:

No destination

With this type of destination floor preselection the information transmitter 1 has only the function of a key. Before each trip the elevator user must communicate his desired destination floor to the elevator control 10, for example within a time window, via the input device 19. Any floor can be selected which is authorized for access by the elevator user in question.

Fixed destination floor

This type of destination floor preselection corresponds to the type with standard destination floor except that the elevator user can specify his own standard destination floor within the authorized range.

Last destination floor selected

The processing unit 9 notes the last trip of each elevator user and, with this type of destination floor preselection, after identification automatically indicates the last trip of the elevator user in question on the display 18.

Learned destination floor

This type of destination floor preselection has already been described above. The processing unit 9 notes the habits of the elevator user in question in relation to the floors which are traveled to, and at what times, and after identification indicates the floor habitually used.

Combinations of the above variants can be selected, for example as a daily profile. A daily profile can be selected, for example, which has the standard destination floor as preselected destination floor between eight and nine, the learned destination floor as preselected destination floor between nine and ten, no destination floor as preselected destination floor between ten and eleven, and the fixed destination floor as preselected destination floor between eleven and twelve.

The invention is not limited by the embodiments described above which are presented as examples only but can be modified in various ways within the scope of protection defined by the appended patent claims.

I claim:

1. A method for operating an elevator installation having a detector which automatically reads data from an information transmitter carried by an elevator user, and a processing unit connected to the detector which, after identifying individual characteristics of the elevator user, preselects and communicates to the elevator user a changeable destination floor, the method comprising the steps of: initially choosing a destination floor preselection procedure to correspond to the user's individual needs; maintaining the chosen type of destination floor preselection procedure in force until a next choice of a different destination floor presentation procedure is made; and choosing a different destination floor preselection procedure and canceling the initially chosen destination floor preselection procedure.

2. A method according to claim 1, wherein the choosing step includes choosing a standard destination floor to be preselected which depends on the user's individual characteristics and is determined by the processing unit, and communicating the standard destination floor to the elevator user each time the individual characteristics have been identified.

3. Method according to claim 1, including choosing no destination floor to be preselected, and after recognition of the individual characteristics and before each trip communicating a desired destination floor to the elevator control via an input device.

4. A method according to claim 1, including choosing a fixed destination floor to be preselected, the elevator user being able to specify a destination floor according to his wish and within his authorized range, communicating the fixed destination floor to the elevator user each time after recognition of the individual characteristics.

5. A method according to claim 1, including choosing a destination floor to be preselected which is a last selected destination floor, and communicating the last selected destination floor to the elevator user each time after the individual characteristics are recognized.

6. A method according to claim 1, including choosing a destination floor to be preselected which is a destination floor learned by the processing unit, the destination floor which has been learned depending on habits of the elevator user being communicated to the elevator user each time after the individual characteristics are recognized.

7. A method according to claim 1, including choosing a profile with at least two types of destination floor preselection, the destination floor preselections following chronologically.

* * * * *